United States Patent [19]

Hutton et al.

[11] Patent Number: 4,660,240

[45] Date of Patent: Apr. 28, 1987

[54] DEVICE FOR ATTACHING SHEETS TO A WATERBED

[76] Inventors: William B. Hutton; Deanice B. Hutton, both of 34452 Bachelor Flat Rd., St. Helens, Oreg. 97051

[21] Appl. No.: 733,701

[22] Filed: May 13, 1985

[51] Int. Cl.[4] ..... A44B 21/00; A47C 21/02

[52] U.S. Cl. ..... 5/451; 5/498; 5/508; 24/72.5; 24/300; 24/459; 24/460; 24/658

[58] Field of Search ..... 5/451, 496, 498, 482, 5/400, 508; 24/72.5, 460, 522, 459, 658, 300, 301, 302, 141

[56] References Cited

U.S. PATENT DOCUMENTS

| | | | |
|---|---|---|---|
| 371,035 | 10/1887 | Crandall | 24/459 |
| 557,456 | 3/1896 | Utter | 24/72.5 |
| 697,808 | 4/1902 | Chauvet | 24/459 |
| 1,153,334 | 9/1915 | Oswald | 24/300 |
| 1,602,305 | 10/1926 | Helm | 24/72.5 |
| 1,892,841 | 1/1933 | Kaufman | 24/301 |
| 3,092,848 | 6/1963 | Gronvold | 5/498 |
| 3,328,854 | 7/1967 | Tombari | 24/141 |
| 4,089,075 | 5/1978 | May | 5/498 |
| 4,393,558 | 7/1983 | Herwegh et al. | 24/459 |
| 4,486,909 | 12/1984 | McKneelan | 5/451 |

FOREIGN PATENT DOCUMENTS

| | | | |
|---|---|---|---|
| 435869 | 10/1926 | Fed. Rep. of Germany | 24/72.5 |
| 1040473 | 10/1958 | Fed. Rep. of Germany | 24/459 |
| 2052940 | 5/1972 | Fed. Rep. of Germany | 5/498 |
| 966658 | 10/1950 | France | 24/522 |

*Primary Examiner*—Alexander Grosz

*Attorney, Agent, or Firm*—Chernoff, Vilhauer, McClung & Stenzel

[57] ABSTRACT

A bed sheet attachment device for use in combination with a waterbed of the type having an upwardly open box-like base holding a fluid-filled flexible mattress. A flat first member of the attachment device defines an opening including a slot and a larger portion connected therewith. A cooperative stud has a neck which fits in the slot, and two larger portions on opposite ends of the neck. At least one of the larger portions of the stud is smaller than the larger part of the opening, so that the stud will fit matingly in the slot with a part of a bed sheet protruding through the slot and wrapped around the neck of the stud. A flexible elastic member connects the first member to the interior of the base of the waterbed, applying tension which urges the stud and sheet toward the narrow end of the slot and holds the sheet in place on the waterbed.

5 Claims, 4 Drawing Figures

DEVICE FOR ATTACHING SHEETS TO A WATERBED

BACKGROUND OF THE INVENTION

The present invention relates to devices for securing bedding in place on beds, and particularly to a device for fastening sheets in place on a waterbed.

Waterbeds of the most common type include a sturdy base supporting a box-like frame which usually includes wooden boards lying on edge and fastened together at the four corners of the frame. This box-like frame contains and supports a fluid-holding mattress. The mattress is, essentially, a water-filled flexible bag, usually of a sheet plastics material. Ordinarily, a heater maintains the water at a desired temperature and chemicals are used to prevent growth of algae within the mattress.

Because such waterbeds provide a great deal of comfort and in their basic form are less expensive than conventional bedding, waterbeds are increasingly popular. It is also recognized that the support provided by a waterbed is often more appropriate for a person suffering from arthritis or back ailments, and this factor also contributes to the increasing popularity of waterbeds.

A particular disadvantage of waterbeds, however, in comparison with conventional boxspring and mattress bedding, is that it is very difficult to make the sheets used on waterbeds remain neat and snug on the top of the waterbed mattress. Although the bed may be made up neatly, as soon as one rests on it the sheets begin to bunch up and come untucked from around the edges of the waterbed mattress.

This tendency for the sheets to come loose from a waterbed has been countered previously by using very large sheets with plenty of extra material to be tucked under the mattress, by providing diagonal straps on the corners of a waterbed sheet, and by providing pockets at the corners of sheets designed especially for use on waterbeds. While such techniques are useful on conventional mattresses, they fail to solve the problem of sheets coming loose from waterbeds.

Particularly for top sheets, failure to stay securely tucked in place is a serious problem with waterbeds. For that reason top and bottom sheets are often provided as a sewn-together combination. While this helps somewhat to solve the problem of the sheets becoming loose from the bed, it results in a bed sheet 12 feet or more in length, which is very difficult to launder.

Any of the currently available sheets designed particularly for waterbeds are at least somewhat difficult to fit onto a waterbed mattress, because of the great weight of the water contained in a waterbed mattress. In order to tuck a pocket portion of a waterbed sheet around a corner of the mattress, a considerable amount of water weight must be lifted. This usually must be accomplished by a person standing bent over bedside the bed, and is, at best, an awkward and difficult task. Many women, particularly those who are small in stature, find the routine task of changing the sheets of a waterbed a very difficult one.

Not only is it difficult to replace conventional waterbed sheets, but the sheets designed specifically for waterbeds are much more expensive than sheets for a conventional bed of a comparable size. This is because of the extra fabric required in such sheets to enable the edge of a waterbed sheet to be tucked around and beneath the waterbed mattress, and because of the extra labor and materials involved in providing pockets or corner straps to attempt to hold such waterbed sheets neatly in place on the bed. Additionally, since most waterbed sheets are sold at the place and time of sale of a new waterbed, a premium price is often charged for waterbed sheets. The result is that waterbed sheets are available in a relatively small number of colors and patterns, by comparison with the available selection of conventional bed sheets. It is therefore undesirably difficult to obtain waterbed sheets which match the decor of a bedroom.

What is needed, therefore, is a device for attaching sheets to a waterbed so as to hold them neatly in place on a waterbed mattress, and so that the sheets used on a waterbed will remain smooth and neat and will not bunch up uncomfortably beneath the person sleeping on the bed. Preferably, such a device would be inexpensive and easily installed, and would make it unnecessary to use expensive, specially designed sheets on a waterbed.

SUMMARY OF THE INVENTION

The present invention overcomes the aforementioned shortcomings and disadvantages of sheets for waterbeds by providing an easily installed bed sheet attachment device for holding sheets in place on a waterbed. According to the present invention, a bed sheet attachment device for use in combination with a waterbed includes a two-part fastener for gripping the sheets of a waterbed, preferably at locations near the corners of the waterbed. The fastener is connected by an elastic strap to the interior of the frame surrounding the waterbed mattress, so that it continuously applies a small amount of tension, keeping the waterbed sheets neatly taut despite some movement of the mattress.

In particular, the fastener portion of the waterbed sheet attachment device of the present invention includes a plate defining a slot extending through it. One end of the slot is enlarged to receive one end of a stud, with a portion of the bed sheet around the stud. The plate is placed beneath the sheet and the stud is pushed down through the enlarged portion of the slot from above the sheet, with the sheet being forced into the slot. The stud is then slid into the narrow portion of the slot to grip the sheet.

An elastic connection is provided between the plate and the frame of the waterbed, to apply a small amount of tension, yet permit movement as required. Preferably, a grommet is provided to form and retain a loop in a length of elastic tape, and a screw normally used to hold the frame of the waterbed together is placed through the grommet to connect the plate to the interior of the waterbed frame. When the attachment device is properly installed, it is unnecessary to lift the water-filled mattress to place sheets neatly on a waterbed, and the stud is out of sight between the mattress and the bed frame when the device is holding sheets in place on a bed.

As a result, flat sheets in a size which is smaller than that normally used on a conventional bed may be used on a waterbed of the same size, making a much larger available selection of sheets useable on waterbeds. Because the sheets made useable on a waterbed by the present invention are smaller and are stocked in more stores, with more price competition, the present invention greatly reduces the cost of providing sheets for waterbeds.

It is therefore a principal object of the present invention to provide a device for holding sheets neatly in place on a waterbed.

It is another important object of the present invention to provide a device by which sheets can be fastened in place on a waterbed quickly and easily and without having to lift a corner of a heavy waterbed mattress.

It is yet another object of the present invention to provide a fastener for holding bed sheets securely in place on a waterbed without damaging the sheets.

An important feature of the present invention is the combination of a stud and a member defining a slot for cooperatively grasping and holding bed sheets by gripping the bed sheet between a neck portion of the stud and the interior of the slot.

Another important feature of the invention is the provision of an elastic fastening strap to provide tension enough to keep sheets snugly and neatly in place, yet provide a required amount of freedom of movement.

It is a principal advantage of the present invention that it allows use on a waterbed of sheets which are smaller, and thus less expensive, than the previously required bed sheets specifically designed for use on waterbeds.

Another important advantage of the present invention is that it enables a waterbed to be kept neater in appearance than previously has been possible.

Yet a further advantage of the present invention is that it results in a much greater selection of available bed sheets to be used on a waterbed Yet a further advantage of the present invention is that it makes it much easier to change the sheets of a waterbed than was possible using the previously availabe specially designed waterbed sheets.

The foregoing the other objectives, features and advantages of the present invention will be more readily understood upon consideration of the following detailed description of the invention taken in conjunction with the accompanying drawings.

DETAILED DESCRIPTION OF THE INVENTION

Figure 1:
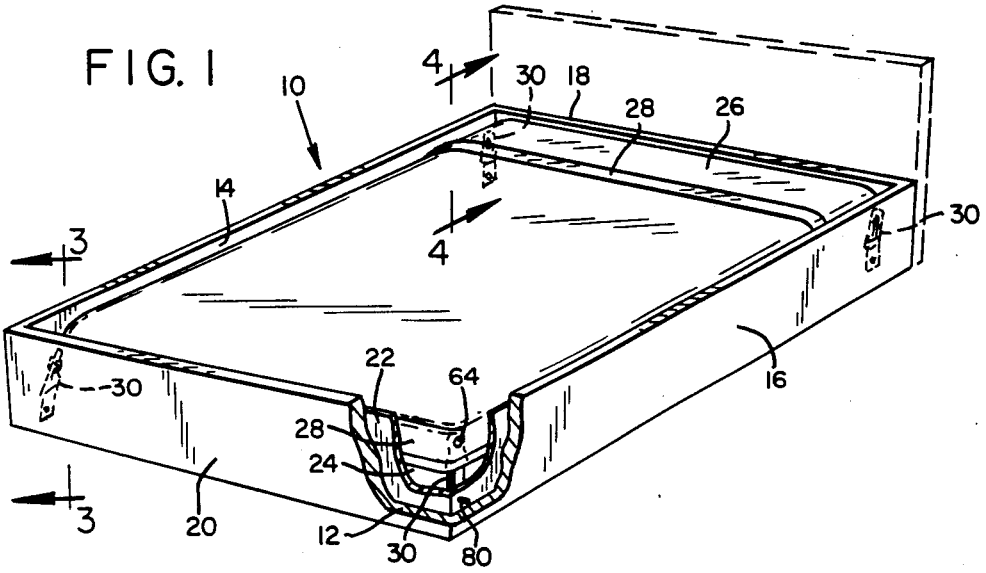
FIG. 1 is a perspective, partially cut-away, view of a waterbed equipped with bed sheet attachment devices embodying the present invention.

Referring now to the drawings, a waterbed 10, shown in FIG. 1, includes a frame having a base 12 and four upstanding walls, a pair of opposite side walls 14 and 16, a head wall 18, and a foot wall 20. The walls are supported on the base 12, forming an upwardly open box-like container. A liner 22 is located within the frame to prevent escape of water which might leak from a mattress 24. As is well known, the mattress 24 is a flexible water-tight container holding a quantity of water.

A pair of sheets, a bottom sheet 26 and a top sheet 28, are held on the waterbed 10, neatly and snugly stretched across the top of the mattress 24 by a plurality of bed sheet attachment devices 30. Preferably, one of the bed sheet attachment devices 30 is attached to a respective one of the walls 14, 16, 18 and 20 adjacent each of the corners formed by intersection of adjacent ones of the walls. The sheet attachment devices 30 hold the sheets and apply a desired amount of tension to hold them snugly in a desired position atop the mattress 24 as will be explained presently.

Figure 2:
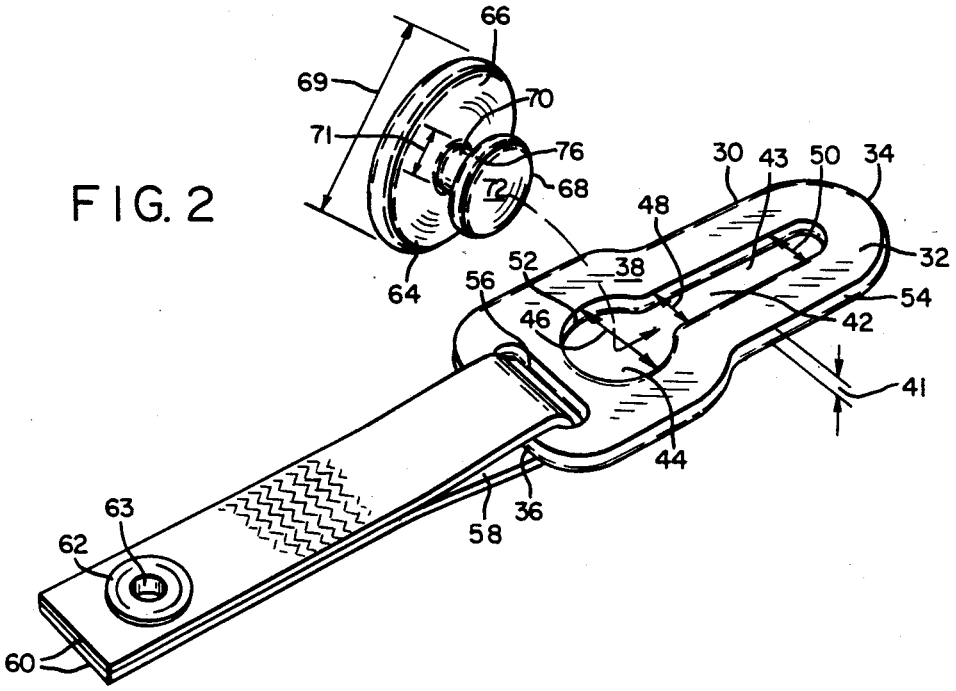
FIG. 2 is a perspective view of one of the bed sheet attachment devices shown in FIG. 1, at an enlarged scale.

As may be seen in FIG. 2, each of the attachment devices 30 includes a plate-like first member 32 which may be made of a conveniently formed material such as a tough, rigid plastics material. The first or plate member 32 has an upper end 34 and a lower end 36, the words "upper" and "lower" referring to the normal position of the plate member 32 when the attachment device 30 is in use. The plate member 32 is generally flat, having opposite sides 38 and 40 which are generally parallel, and a thickness 41 which is great enough (for example, about $\frac{1}{8}$ inch) to supply necessary strength and avoid sharp corners or edges which might tear the sheets 26 and 28.

An opening 43 extends through the first member from the first side 38 to the opposite side 40, and includes a slot 42 and a circular portion 44 which intersects the slot 42. The circular portion 44 has a diameter 46 which is greater than the width 48 of the slot 42 where it intersects with the circular portion 44 of the opening. The slot 42 preferably tapers inward slightly to a width 50 at a position close to the upper end 34 of the first member 32. For example, the width 48 may, in a preferred embodiment of the invention be 0.38 inches, while the width 50 is 0.36 inches. As will be appreciated, the circular portion 44 might be of another shape, as long as it is larger than the width 48 of the slot 42. It is necessary, however, that the slot portion 42 extend beyond the circular portion 44 toward the upper end 34 of the plate member 32.

Preferably, the marginal surfaces 52 and 54 along the opening and the outer edge of the plate member 32 are arcuately convex, so as not to catch the fabric of the bed sheets 26 and 28.

A transverse slot 56 extends substantially perpendicular to the slot 42 through the first member 32 from the first side 38 to the opposite side 40 near the lower end 36. A connecting 58, a strap of woven elastic tape, for example, exteds through the slot 56 and has its opposite end portions 60 held together and parallel with one another by a grommet 62 forming an elongate loop. The grommet 62 may be of well known design and includes a central opening 63 having a diameter large enough, for example, approximately 0.3 inch, to accept a screw 80 (FIG. 4) of the size normally used to fasten together the walls of the frame of the waterbed 10. The elastic tape 58 in a preferred embodiment of the invention is one inch wide, and the distance between the grommet 62 and the slot 56 is about 3 inches. Preferably, the elastic connecting member 58 may be stretched about 2 inches beyond its relaxed length.

Figure 3:
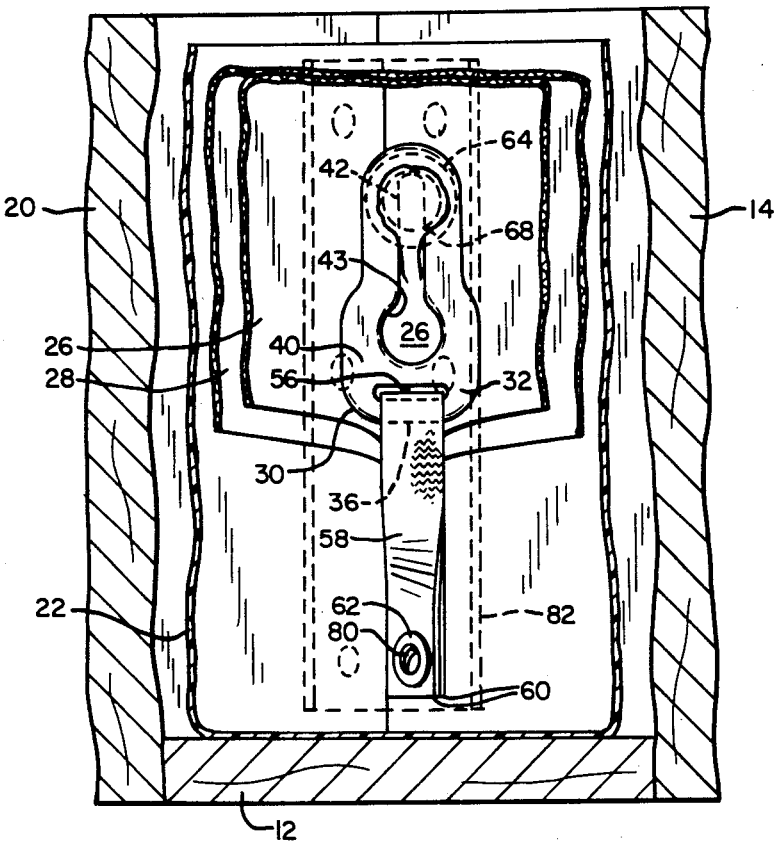
FIG. 3 is a view taken along line 3—3 of FIG. 1, showing one of the sheet attachment devices of the present invention in use, at an enlarged scale.

A stud 64 includes a circular head portion 66 about 1.25 inches in diameter, a base portion 68 having a diameter 69 of about 23/32 inch, and a cylindrical neck portion 70 whose diameter 71 is about 0.32 inch in a preferred embodiment of the invention. As the base portion 68 is smaller in diameter than the circular portion 44 of the opening 43, and because the widths 48 and 50 within the slot portion 42 are greater than the diameter of the neck 70, the stud 64 may be fitted into the slot 42 of the opening in the first member 32 as is shown in FIGS. 3 and 4, with portions of the sheets 26 and 28 extending around the base 68 and neck 70. Sufficient clearance, but a snug fit, is provided between the neck 70 and the interior of the slot portion 42 to hold the sheets 26 and 28 securely when the stud 64 is located within the slot 42 near the upper end 34 of the plate member 32.

Preferably, the base 68 has a flat bottom surface 72, a frusto-conical upper surface 74, and a rounded edge 76 joining the bottom 72 and the upper surface 74, in order to avoid unnecessarily stressing a sheet held by the attachment device 30.

Figure 4:
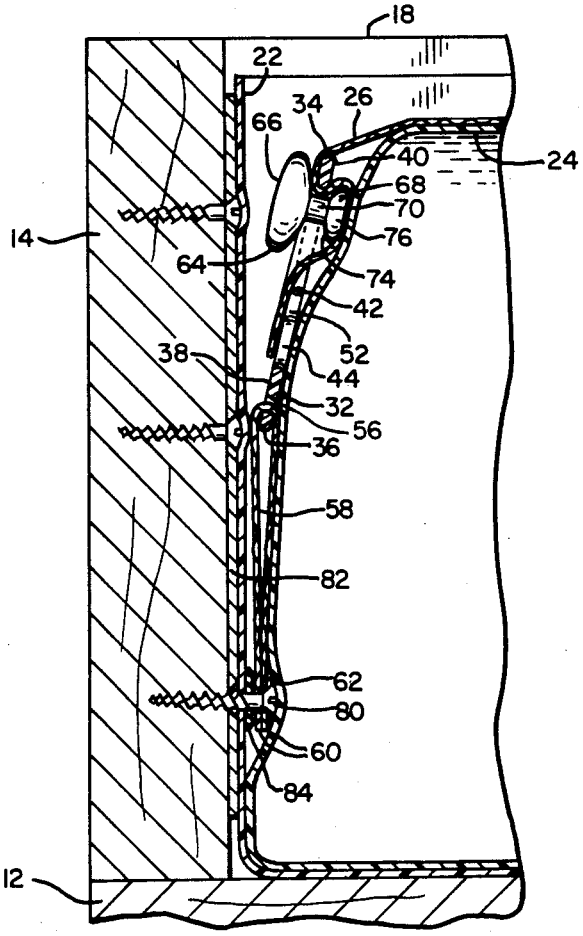
FIG. 4 is a sectional view of the bed sheet attachment device of the invention and a portion of the waterbed, taken along line 4—4 of FIG. 1

Referring now to FIGS. 3 and 4, the attachment device 30 is installed in the waterbed 10 by moving the liner 22 away from the respective walls of the waterbed frame. A screw 80, normally used at a location low on one of the walls 14, 16, 18, or 20 to hold a corner bracket 82 in place joining the respective ones of the walls, is removed and the liner 22 is then replaced in its original location. The screw 80 is placed through the opening of the grommet 62, and, if desired, through a rubber washer 84, and is then inserted through the liner 22 and replaced into the hole in which it was originally located in the bracket 82. The screw 80 should be tightened to hold the attachment device 30 fastened securely to the respective one of the walls. If corners brackets are not used in the construction of the waterbed, a screw 80 may simply be inserted through the liner 22 into one of the walls of the frame at each corner of the waterbed. The process of installation is the same in each of the corners of the waterbed.

Although it is unlikely that any liquid leaking from the mattress 24 would rise as high as the hole made in the liner 22 before being noticed, and although it is also likely that simply tightening the screw 80 would provide a sufficiently tight seal around the opening made by piercing the liner 22, the rubber washer 84 provides an additional measure of security against leakage of water from the mattress 24 being able to escape from the liner 22.

To attach the bed sheets 26 and 28 to the waterbed 10, each sheet is laid over the plate member 32, which is held in a desired position adjacent the corner of the mattress 24, with a desired amount of tension applied to the elastic connecting member 58. While the plate member 32 is held in the desired position, with the sheets 26 and 28 in place above it, the base 68 of the stud 64 is pushed through the circular portion 44 of the opening in the plate member, pushing a small part of the sheets through the circular portion of the opening. The stud 64 is then slid into the slot portion 42 with the sheets 26 and 28 surrounding the neck portion 70. The same process is repeated at each corner of the waterbed 10, with only the bottom sheet 26 being attached in this fashion at the head of the bed. When the sheets 26 and 28 have been attached to the waterbed 10 in this fashion, at most only the head 66 of each of the studs 64 will be visible, and even the heads 66 will ordinarily be out of view, between the mattress 24 and the walls of the frame of the waterbed 10.

When using the bed sheet attachment devices 30 of the present invention it is unnecessary to utilize the extremely large bed sheets designed specifically for use with waterbeds, and sheets which are even smaller than would be required for a conventional bed of the same nominal mattress size may be used. For example, flat sheets of the size (81 by 96 inches) recommended for a full (double) bed are large enough to properly cover a king size waterbed (mattress top size 72 by 84 inches) when held in place by the attachment devices 30 of the present invention. Correspondingly, twin bed flat sheets (66 by 96 inches) may be used on queen size (60 by 84 inches) and smaller waterbeds satisfactorily. Thus, when using the attachment devices 30, the cost of bed sheets for the waterbed 10 is greatly reduced, while the appearance of the waterbed 10 is greatly improved and maintained, even during use.

The terms and expressions which have been employed in the foregoing specification are used therein as terms of description and not of limitation, and there is no intention in the use of such terms and expressions, of excluding equivalents of the features shown and described or portions thereof, it being recognized that the scope of the invention is defined and limited only by the claims which follow.

What is claimed is:

1. A bed sheet attachment device for use in combination with a waterbed of the type having a frame including upstanding walls surrounding at least a portion of a fluid-holding mattress, the bed sheet attachment device comprising:

(a) a plate-like member of plastic material having a first side, a second side, an upper end, and a lower end, said plate-like member defining an opening extending therethrough from said first side to said second side, said opening including a longitudinally-oriented slot having a width, and said opening further including a larger portion which is larger than said width and which communicates with said slot, at least a part of said slot extending from said larger portion toward said upper end, said plate-like member further defining a transverse slot extending therethrough from said first side to said second side and located adjacent said lower end;

(b) elastic connecting means attached to said lower end, for connecting said plate-like member to a portion of the frame of a waterbed, said elastic connecting means including an elastic tape having a pair of ends, said tape extending through said transverse slot and said ends being fastened together parallel with one another by a grommet defining a central opening for receiving a fastener therethrough; and (c) a stud, having a base, a disk-shaped head which is larger than said base, and a relatively narrow neck portion located between and interconnecting said head and base, said neck being no thicker than said width of said slot, said head and base each being too large to pass through said slot, and at least one of said head and said base being small enough to pass through said larger portion of said opening.

2. The device of claim 1 wherein said slot is tapered and said width is minimum at the portion of said slot closest to said upper end of said first member.

3. A bed sheet attachment device for use in combination with a waterbed of the type having a frame including upstanding side walls surrounding at least a portion of a fluid-holding mattress, the bed sheet attachment device comprising:

(a) a plate-like member having an upper end and a lower end;

(b) means for defining a stud-holding opening extending through said plate-like member;

(c) means defining a transverse slot located in said plate-like member between said stud-holding opening and said lower end;

(d) a stud having a pair of opposite ends and a relatively slender neck interconnecting said opposite ends;

(e) said stud-holding opening including a slot portion having a width, adjacent said upper end of said plate-like member, which is great enough to receive said neck of said stud and at least one layer of cloth wrapped around said neck, but said width being small enough to prevent said ends of said stud from passing therethrough; and (f) elastic connecting means attached to said lower end, for connecting said first member to a portion of the frame of a waterbed, said elastic connecting means including an elastic tape having a pair of ends, said tape extending through said transverse slot and said ends being fastened together parallel with one another by a grommet defining a central opening for receiving a fastener therethrough.

4. A waterbed, comprising:

(a) a mattress-supporting frame, including respective generally vertical head end, foot end, and opposite side wall members defining a plurality of corners of said frame;

(b) a fluid-holding mattress supported on said frame with said wall members thereof extending upwardly alongside at least a part of said mattress; and (c) a plurality of bed sheet attachment devices each including (i) a plate-like member of plastic material, having an upper end and a lower end;

(ii) a stud having a head, a base, and a relatively slender neck interconnecting said head and said base;

(iii) means for defining an opening through said plate-like member, said opening including a tapered slot portion large enough to receive said neck of said stud but too small for either said head or said base to pass therethrough, said opening further including an enlarged portion which is located proximate said lower end and which is large enough to permit passage of at least said head therethrough;

(iv) means defining a transverse slot passing through said plate-like member, located between said lower end of said plate-like member and said enlarged portion of said opening;

(v) elastically extendable connecting means including an elastic strap having first and second ends, said elastic strap being disposed through said transverse slot and said first and second ends of said strap being permanently held together parallel with one another by a fastener associated with said first and second ends of said elastic strap so as to form a loop therein; and (vi) attachment means for holding said fastener to said frame proximate one of said corners, said fastener defining a central opening for receiving said attachment means.

5. The waterbed of claim 4 wherein said attachment means is a grommet mounted in said first and second ends.

* * * * *

UNITED STATES PATENT AND TRADEMARK OFFICE

CERTIFICATE OF CORRECTION

PATENT NO. : 4,660,240

DATED : April 28, 1987

INVENTOR(S) : William B. Hutton, et al.

It is certified that error appears in the above-identified patent and that said Letters Patent is hereby corrected as shown below:

| | | | |
|---|---|---|---|
| Col. 1, | Line 56 | Change "bedside" to --beside--; |
| | Line 66 | Change "edge" to --edges--. |
| Col. 3, | Line 30 | After "waterbed" insert a period; |
| | Lines 33-34 | Change "availabe" to --available--; |
| | Line 35 | Change "the" to --and--. |
| Col. 4, | Line 45 | After "connecting" insert --member--; |
| | Line 46 | Change "exteds" to --extends--. |
| Col. 5, | Line 25 | Change "corners" to --corner--. |

Signed and Sealed this

First Day of March, 1988

*Attest:*

*Attesting Officer*

DONALD J. QUIGG

*Commissioner of Patents and Trademarks*